US007490716B2

(12) United States Patent
Pleven

(10) Patent No.: US 7,490,716 B2
(45) Date of Patent: Feb. 17, 2009

(54) DEVICE FOR PROTECTING, DISPLAYING AND USING A COIN FOR STANDARD ORNAMENTATION PURPOSES

(76) Inventor: Ludovic Joel Georges Pleven, 11, Route de l'Epau, Change (FR) F-72560

( * ) Notice: Subject to any disclaimer, the term of this patent is extended or adjusted under 35 U.S.C. 154(b) by 208 days.

(21) Appl. No.: 10/505,536

(22) PCT Filed: Feb. 14, 2003

(86) PCT No.: PCT/FR03/00489

§ 371 (c)(1),
(2), (4) Date: Aug. 24, 2004

(87) PCT Pub. No.: WO03/071902

PCT Pub. Date: Sep. 4, 2003

(65) Prior Publication Data

US 2005/0150780 A1 Jul. 14, 2005

(30) Foreign Application Priority Data

Feb. 26, 2002 (FR) ..... 02 02426
Feb. 12, 2003 (FR) ..... 03 01642

(51) Int. Cl.
*A45C 1/00* (2006.01)
*B65D 85/58* (2006.01)

(52) U.S. Cl. ..... 206/0.8; 206/0.82; 206/445

(58) Field of Classification Search ..... 206/0.8, 206/0.82, 303, 445; 40/27.5, 661.05, 661.06; 63/18, 19; D14/482
See application file for complete search history.

(56) References Cited

U.S. PATENT DOCUMENTS 2,863,307 A * 12/1958 Donle ..... 63/19
4,063,639 A * 12/1977 Grant ..... 206/0.82
5,109,977 A * 5/1992 Mayer et al. ..... 206/0.8
5,414,948 A * 5/1995 Kudo ..... 40/651

* cited by examiner

*Primary Examiner*—Mickey Yu
*Assistant Examiner*—Steven A. Reynolds

(57) ABSTRACT

The invention is composed of a base structure (2) with first and second annular symmetric parts linked by a connecting element with a space to introduce a suspension system, the structure (2) can be folded thanks to the connecting element so that the first and second parts face one another. An independent coin support system is disposed in the structure (2) and is made of two identical superimposed internal rings (5) which define an opening that houses a coin or an adaptive structure (9) for a coin with a smaller diameter. Each ring defines on first or second parts of the structure (2) an outer support lip (7) to hold independent protection interfaces (11) on each side of the coin. Closing systems are curved with a U-shaped section and placed in periphery of the device (1). Interposition rings (13) (14) can be placed inside.

7 Claims, 6 Drawing Sheets

DEVICE FOR PROTECTING, DISPLAYING AND USING A COIN FOR STANDARD ORNAMENTATION PURPOSES

TECHNICAL FIELD OF THE INVENTION

The invention relates to a device that is employed to protect, display and use a coin, comprising a base structure consisting of first and second parts which are linked by a connecting element, at the level of which the base structure can be folded so as to bring the first and second parts to face one another. Coin support means, which are adapted to the diameter of the coin, are disposed in the base structure.

BACKGROUND OF THE INVENTION

The devices known for preserving a coin generally comprise a case of protection with a glass frame, in which the coin is laid out such as described in the document U.S. Pat. No. 3,100,567. Some known devices, such as the one described in the document U.S. Pat. No. 4,915,214 adapt to various diameters of coins by means of a ring whose internal and external diameters are adapted respectively to the coin and to the internal frame of the case.

The majority of the known devices only allow the protection of the coin, and not its everyday use. Thus, the structure of such devices is generally rigid and comprises closing systems that work by screwing, interlocking, or fitting. However, these devices are not easy to implement and cannot always be reopened in a simple and reliable way. Other systems have a simple structure, but are not able to ensure a sufficient protection of a coin, when the latter is meant for everyday use.

OBJECT OF THE INVENTION

The purpose of the invention is a device that is employed to protect, display and use a coin, and that is easy to implement and able to adapt to different diameters and thicknesses of coins. This device can be opened easily while allowing a reliable closing.

According to the invention, this goal is reached by the fact that:

- The first and the second parts are annular with a predetermined internal diameter,
- support means comprise two identical superimposed internal rings, which define an opening that is intended to house the coin. The diameter of the opening in the aforementioned internal rings is slightly greater than the internal diameter of the first and second parts of the base structure. In this way, each internal ring defines a non-covered annular area on one of the first or second parts of the base structure, said area forming an outer support lip,
- closing systems enclose at least one zone of the periphery of the device.

According to a development of the invention, the device comprises an annular adaptive structure with an opening to contain a coin whose diameter is smaller than the internal diameter of the first and the seconds parts, said adaptive structure is meant to be placed in the opening of the two internal rings.

According to a preferential mode of realization, the periphery of the adaptive structure comprises lugs, diametrically opposed, which adapt to cavities present in the internal rings. This avoids the rotation of the adaptive structure in the internal rings.

According to another characteristic of the invention, the device comprises two interposition rings respectively arranged on the two faces of the adaptive structure, the internal diameter of said interposition rings is inferior to the internal diameter of the adaptive structure in order to form internal lips.

SUMMARY DESCRIPTION OF THE DRAWINGS

Other advantages and characteristics will stand out more clearly from the description, which will follow, of particular modes of realizing this invention. These non-restrictive examples are represented in the drawings annexed, in which.

DESCRIPTION OF PARTICULAR MODES OF REALIZATION

Figure 1:
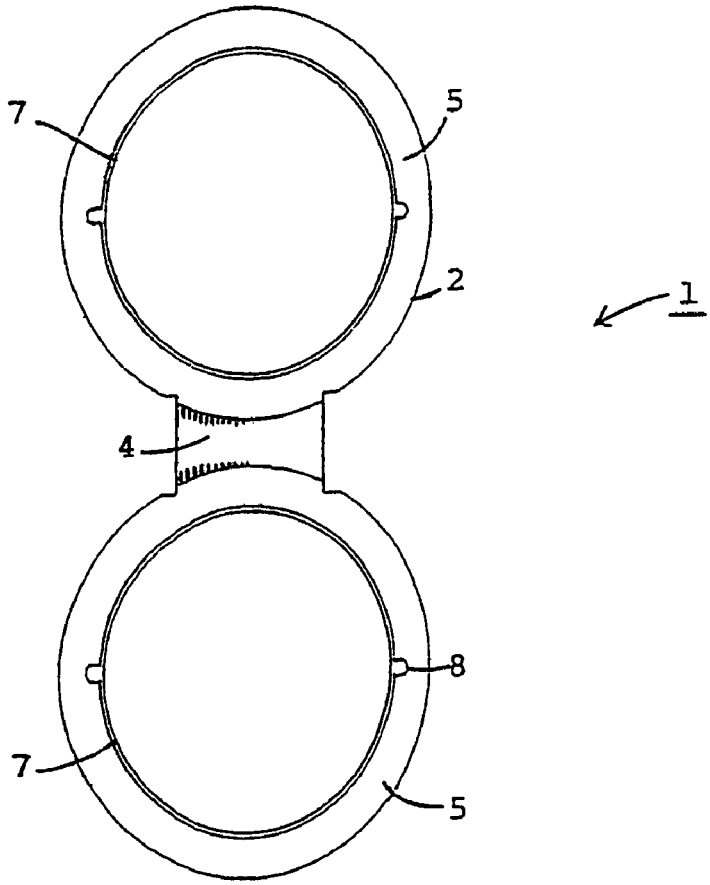
FIG. 1 represents a particular mode of realization of a device according to the invention, in open position.
Figure 2:
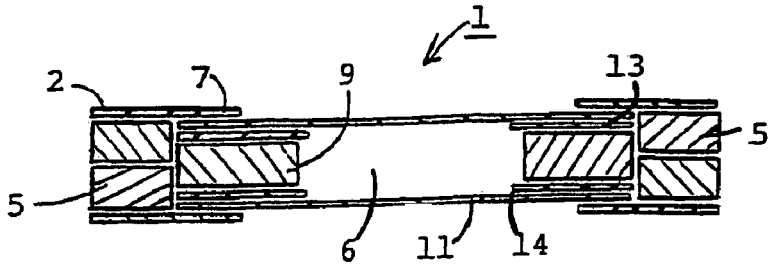
FIG. 2 is a cross-section of a device according to the invention, in closed position, see FIG. 11 for position of sectional line and direction of sight.
Figure 3:
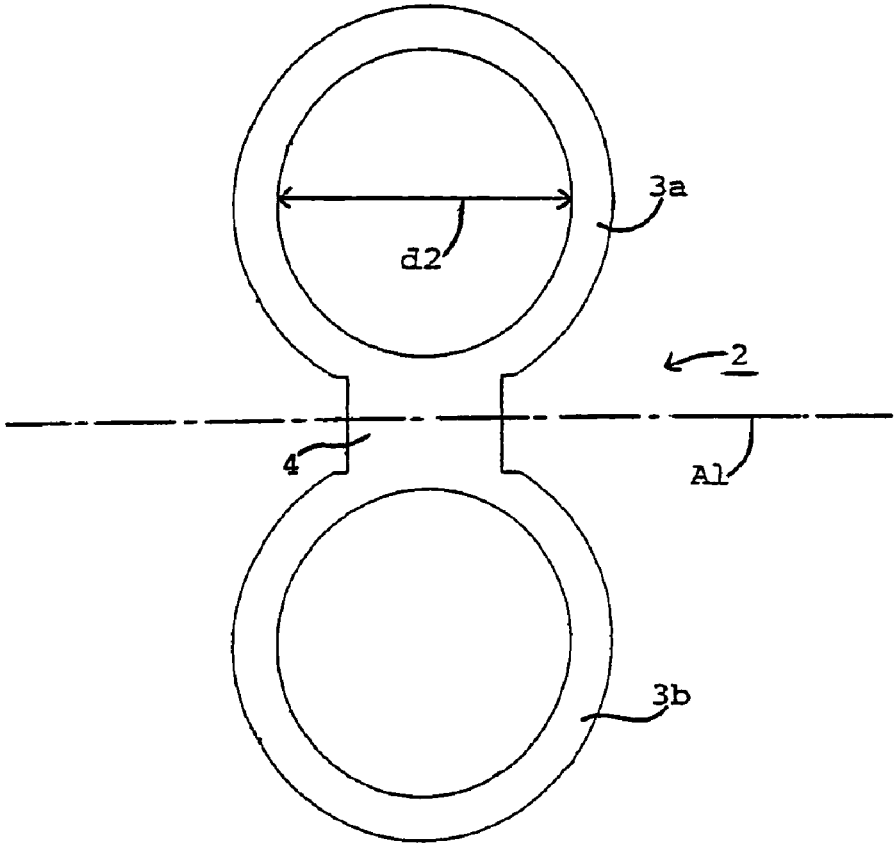
FIG. 3 represents a base structure of a device according to the invention.
Figure 10:
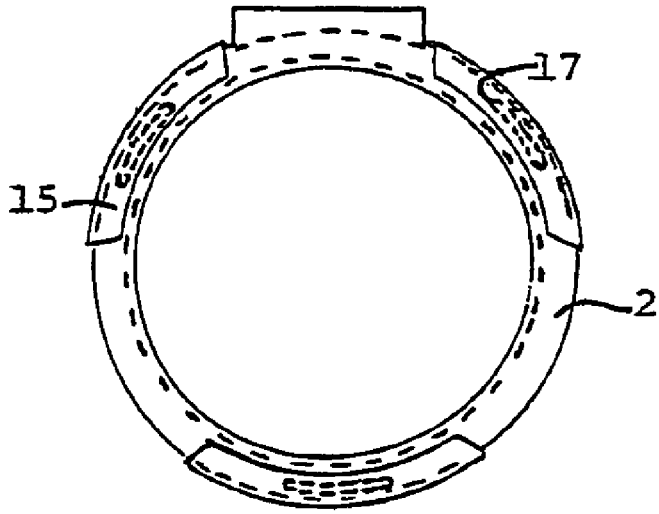
FIG. 10 is a schematic representation of a device according to the invention comprising closing elements as in FIG. 9.

As shown in FIG. 1, a device 1 for protecting, displaying and using a coin consists of a base structure 2 whose role is to contain and protect a coin and which is able to pass from an open position (FIG. 1) to a closed position (FIGS. 2 and 10). As shown in FIG. 3, the base structure 2 is composed of first and second annular parts 3*a* and 3*b* linked by a connecting element 4. To switch to a closed position, the base structure 2 is folded according to an axis A1, at the level of the connecting element 4, so as to bring the first and second annular parts 3*a* and 3*b* to face one another.

Figure 4:
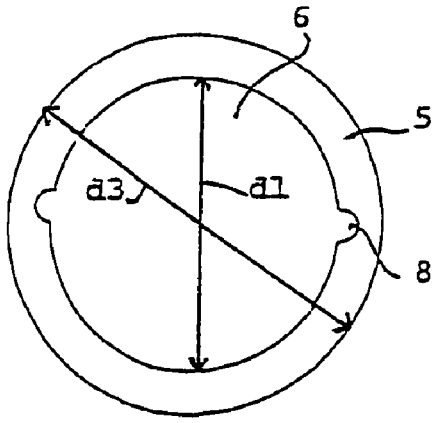
FIG. 4 represents an internal ring of a device according to the invention.

The device also comprises coin support means adapted to the diameter of the coin and arranged in the base structure 2. The support means comprise two identical superimposed internal rings 5 (FIG. 4), which define an opening 6, intended to house a coin. The internal rings 5 are laid out between the first and the second annular parts 3*a* and 3*b* when the base structure 2 is closed (FIG. 2). The diameter d1 of the opening 6 of the internal rings 5 is slightly greater than the internal diameter d2 of the first and the second annular parts 3*a* and 3*b* and the external diameter d3 of the internal rings 5 is equal to the external diameter of the annular parts 3*a* and 3*b* (FIGS. 3 and 4). Thus, when the two internal rings 5 are put between the first and second annular parts 3*a* and 3*b*, each internal ring 5 defines, on one of the first or second annular parts 3*a* and 3*b*, a non-covered internal annular area. Each internal annular area forms an outer annular support lip 7 (FIG. 1) which maintains, in the base structure 2, the support means and the coin. Each internal ring 5 can also comprise two cavities 8 diametrically opposed, and whose shape is appreciably circular.

Figure 5:
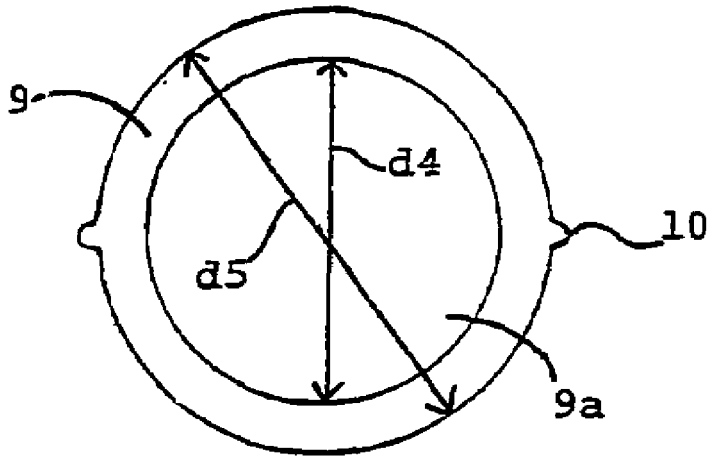
FIGS. 5 and 6 represent adaptive structures of different diameters of a device according to the invention.
Figure 6:
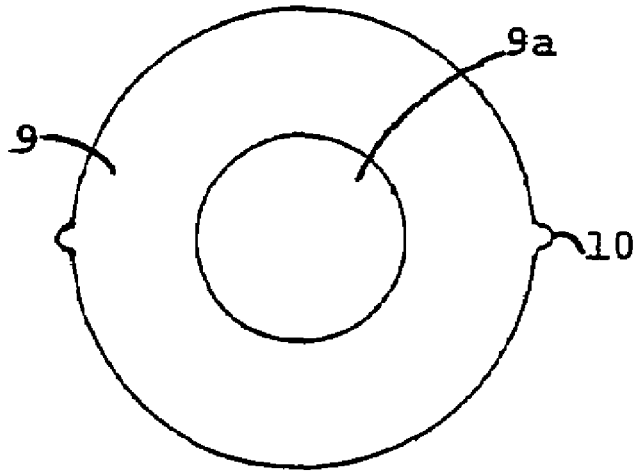

For a coin with a diameter inferior to the internal diameter d2 of the first and second parts 3*a* and 3*b*, the device 1 comprises, preferably, an annular adaptive structure 9, like the one shown in FIG. 5. This adaptive structure 9 is meant to be placed in the opening 6 of the two internal rings 5. The adaptive structure 9 comprises an opening 9*a* whose purpose is to contain the coin. The diameter d4 of the opening 9*a* of the adaptive structure 9 corresponds appreciably to the diameter of the coin and the external diameter d5 of the adaptive structure is appreciably equal to the diameter d1 of the opening 6 of the internal rings 5. the periphery of the adaptive structure 9 comprises, preferably, two lugs 10 diametrically opposed and protruding towards the exterior of the adaptive structure 9, and preferably with an appreciably circular shaped section. The purpose of the lugs 10 is to correspond with cavities 8 of the two internal rings 5 in order to avoid the rotation of the adaptive structure 9 inside the internal rings 5. As shown in FIGS. 5 and 6, the internal diameter d4 of the adaptive structure 9 is adapted to the diameter of the coin that the adaptive structure must contain.

The device comprises, preferably, at least one protection interface 11, disposed in the opening 6 of the internal superimposed rings 5, so as to completely cover one face of the coin. Thus, on FIG. 2, two protection interfaces 11 are arranged on both sides of the adaptive structure 9, in opening 6 of the internal superimposed rings 5. The two internal rings 5 have a thickness allowing to contain at least the protection interface 11 and the adaptive structure 9. The protection interfaces 11 are made of low thickness discs, for example, of glass or plastic. They are preferably rigid, removable and interchangeable. The diameter of the protection interfaces 11 is appreciably equal to the diameter d1 of the opening 6 of the two internal rings 5. Thus, each protection interface 11 is arranged in an internal ring 5 so as to protect the coin. When the base structure 2 is closed, the unit formed by internals rings 5, the adaptive structure 9 and the two protection interfaces 11 is retained by the outer annular support lips 7 of the base structure 2.

Figure 7:
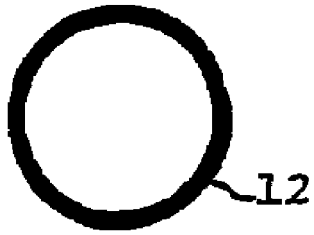
FIGS. 7 and 8 are respectively, a front view of compensation joint and a cross-section of a compensation joint arranged on a part of the device according to the invention.
Figure 8:
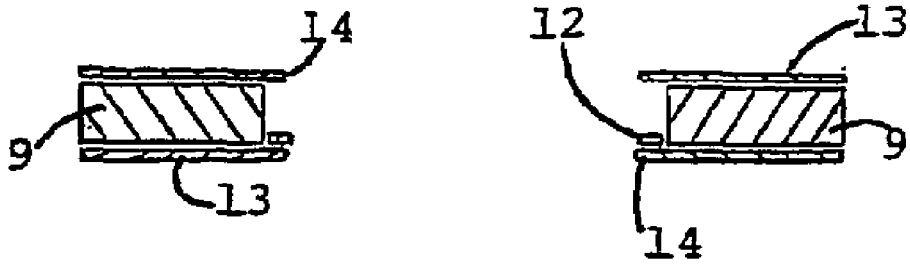

According to an alternative of the design, at least one compensation joint 12 used to compensate the difference in thickness between the coins to be presented, as the one shown in FIG. 7, can be arranged in central circumference of the opening 9*a* of the adaptive structure 9, so that the compensation joint covers the rim, or the beads around the edge when there is no rim, of the coin contained in the adaptive structure 9 (FIG. 8). The compensation joint can be circular, toric or with flat faces. The width of the full part of the joint is appreciably adapted to the rim of the coin and its external diameter corresponds appreciably to the diameter d4 of the opening 9*a* of the adaptive structure 9.

The compensation joint 12 thus blocks the coin within the device by exerting a pressure perpendicular to the plane of the coin, at the level of the rim, without the need for a lateral pressure on the walls of the adaptive structure 9.

The device can also comprise interposition rings. Thus, as shown in FIGS. 2 and 8, two interposition rings 13 are respectively arranged between the adaptive structure 9 and the protection interfaces 11. The interposition rings 13 have an external diameter equal to that of the adaptive structure 9, and an internal diameter inferior to the diameter of the opening 9*a* of the adaptive structure 9. Thus, each interposition ring 13 comprises a free internal annular area constituting an internal lip 14, protruding towards the interior of the adaptive structure 9, when the interposition ring 13 is arranged between the adaptive structure 9 and one of the protection interfaces 11 (FIG. 2). The internal lips 14 block the coin within the adaptive structure 9. The internal diameter of the interposition rings 13 corresponds preferably and appreciably to the diameter of the coin minus the width of the rim or of the beads around the edge if there is no rim. Thus, the internal lips 14 of the interposition rings 13 cover the rim, or the beads around the edge of the coin on all its circumference. The interposition rings 13 make it possible to mask the compensation joints 12 when these are arranged on the rim of the coin. The interposition rings 13 also prevent contact between the coin and the protection interfaces 11, and allow, with or without the compensation joints, to immobilize the coin within the adaptive structure. Thus, the coin can neither turn nor move crosswise in the opening 9*a* of the adaptive structure 9, and this allows the coin to be maintained in the correct position for reading.

The device 1 is maintained in closed position by reversible closing systems enclosing at least a zone of the periphery of the base structure 2. The closing systems can comprise at least one curved structure 15 with a U-shaped section, as shown in FIGS. 9 and 10.

Figure 12:
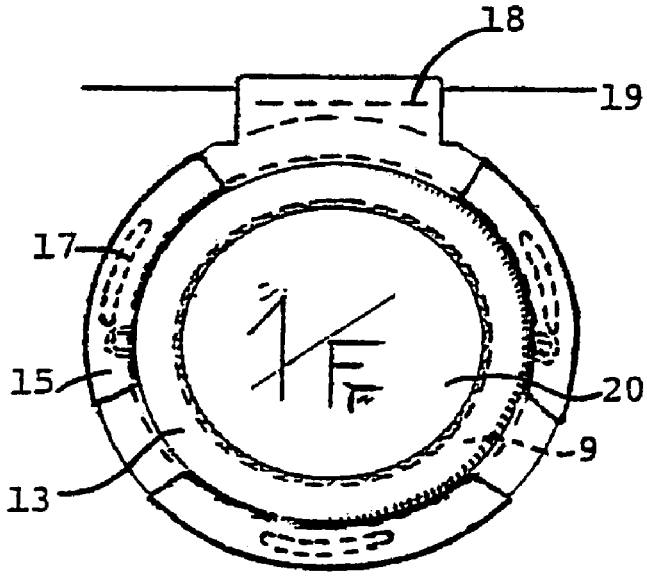

The curved structure 15 is relatively flexible in order to enclose at least a zone of the periphery of the base structure 2, by embedding and by pressure. The closing structure 15 can also enclose the periphery of the protection interfaces 11 which are located under the outer support lips 7, and this so as to add rigidity to the device in closed position. The curve of the curved structure 15 is equal to that of the base structure 2. The internal height H of the curved structure 15 and the thickness of the device in closed position, are appreciably equal (FIG. 12). At least one of the internal lateral walls of each curved structure 15 can comprise a blocking lug 16 meant to correspond with a cavity 17 formed in the base structure 2. This makes it possible to ensure a better immobility of the closing system by a reversible enshrining effect. Thus, as shown in FIG. 9, the curved structure 15 has two lugs 16 which face one another.

Figure 9:
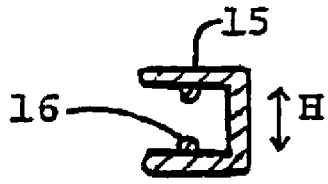
FIG. 9 is a cross-section of a closing element of a device according to the invention.

In FIG. 10, the reversible closing systems comprise three curved structures 15, as the one shown in FIG. 9, and the first and second annular parts 3*a* and 3*b* of the base structure 2 comprise, respectively, three cavities 17, evenly spaced. The curved elements 15 enclose the folded base structure 2 and each lug 16 cooperates with a cavity of the base structure 2. The closing systems thus allow pressure to be exerted on the base structure, leading to a pinch effect on the edges of the external faces of the base structure 2. This makes it possible to transform the device into an integral and closed unit, so that the coin cannot extract itself from the device.

Figure 11:
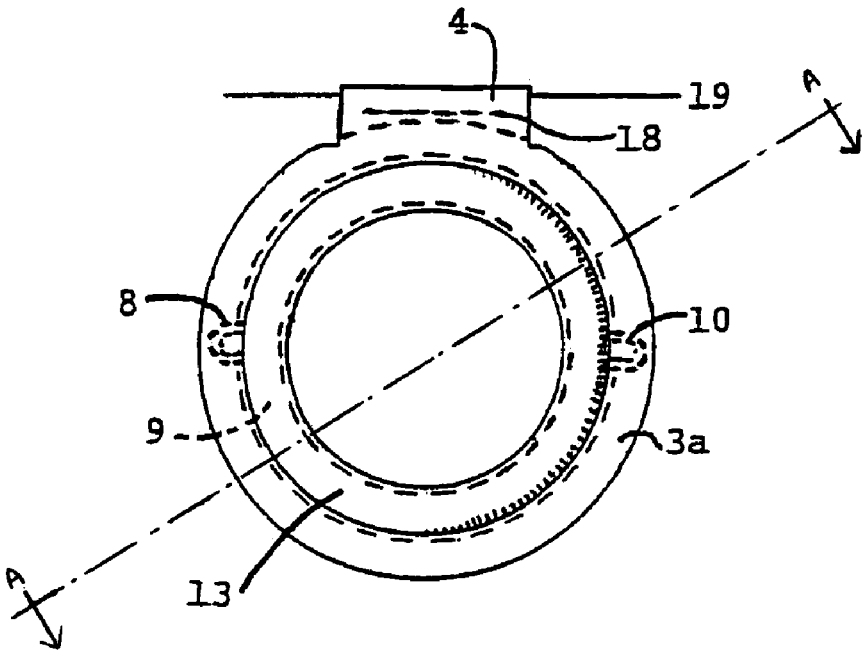
FIG. 11 and 12 represent, in front view, various modes of realization of a device according to the invention, in closed position, with for FIG. 11 a sectional line A-A showing the direction of sight for FIG. 2.

As shown in FIG. 11, a seam point 18 can be made by stitching on the connecting element 4 of the base structure 2, when the latter is folded. Thus the base structure remains in half-closed position while allowing an opening like a bivalve. The seam point nevertheless avoids a too large opening of the first and second annular parts 3*a* and 3*b* due to a spring effect.

A space 19 can be made in the connecting element 4 of the folded base structure 2. Thus, the device can comprise a suspension system such as a ring to form, for example a key-ring, or to convert the device into another presentation means by fixing or hanging the device to any type of known presentation support. In FIG. 11, the space 19 is defined by the seam point 18.

For example, a device represented in FIG. 12, comprises a folded base structure in which are laid out two internal superimposed rings and which comprise three cavities 17, the purpose of these cavities is the closing of the device. An adaptive structure 9, as the one shown in FIG. 5, is laid out in the opening of the two superimposed rings and this adaptive structure comprises, in its centre, a coin 20, and on its faces, an interposition ring 13. Three closing elements 15 enclose the periphery of the base structure so as to close the device, and a seam point 18 is made on the connecting element 4 of the base structure.

A device according to the invention has the advantage of adapting to any type of coin, namely to coins having different thicknesses and diameters. It also makes it possible to protect the two faces of a coin against external elements but also against the supports means contained in the device. Moreover, the device makes it possible to maintain the coin efficiently in the centre of the device, in a correct position for reading, while ensuring a secure and reversible closing. The production of such a device is easy to realize, the various elements of the device can be realized by all types of known methods, for example by cutting out and stamping. The device can be made out of all kinds of known material for example leather, plastic for the protection interface and thin steel for the embedded closing element.

The invention is not limited to the modes of realization described above. Thus, a coin with a larger diameter than the internal diameter d2 of the first and second parts 3*a* and 3*b* can be laid out directly between the two internal rings 5, without requiring the adaptive structure 9.

In this case, the diameter of the opening 6 of the internal rings 5 is appreciably equal to the diameter of the coin to be presented, and two interposition rings 13 can be laid out respectively in central circumference of the internal superimposed rings 5, this on both sides of the coin. The internal diameter of said interposition rings 13 is then smaller than the diameter of opening 6 of the internal rings 5. The device can also comprise at least a compensation joint 12 laid out in central circumference of the internal rings' 5 opening 6. The joint is intended to compensate for the difference in thickness of the coins, by filling the free interval between the rim and an interposition ring 13 and/or between the interposition ring and the protection interface 11, or between the rim and the protection interface. This joint can thus be laid out between the rim of the coin and the interposition rings 13 and/or between the interposition ring and a protection interface, or between the rim and a protection interface. The joints are thus masked by the first outer lips of the base structure 2.

The invention claimed is:

1. Device that is employed to protect, display and use a coin, composed of a base structure (2) consisting of first and second parts (3*a*,3*b*) linked by a connecting element (4) at the level of which the base structure (2) can be folded to bring the first and second parts (3*a*, 3*b*) to face one another, an independent support system for a coin (20) adapted to the diameter of a coin is laid out in the base structure (2), device (1) characterized in that:

the first and second parts (3*a*, 3*b*) are annular and symmetrical to an axis (A1) with a predetermined internal diameter (d2), the support system comprises two internal identical superimposed rings (5), independent from the base structure (2), defining an opening (6) with a suitable predetermined internal diameter (d1) intended to contain a coin (20), the diameter (d1) of the opening (6) of the internal rings (5) being greater than the internal diameter (d2 ) of the first and second parts (3*a*, 3*b*) of the base structure (2), so that each internal ring (5) defines on each of the first or second parts (3*a*, 3*b*) of the base structure (2) a non-covered internal annular area that constitutes an outer support lip (7) to hold an independent protection interface (11) laid out in the opening (6) of the two internal superimposed rings (5), on each side of the coin so as to cover the coin completely, a space (19) is made, in folded position, between the connecting element (4) of the base structure (2) and the support system (5), a suspension system is introduced into this space, an annular adaptive structure (9) composed of an opening (9*a*) intended to contain a coin (20) with a diameter smaller than the internal diameter (d2) of the first and second annular parts (3*a*,3*b*), can be placed in the opening (6) of the two internal rings (5), the periphery of the adaptive structure (9) comprises two lugs (10) diametrically opposed and meant to correspond with cavities (8) formed in the internal rings (5), in order to avoid rotation of the adaptive structure (9) in the internal rings (5), closing systems are curved elements (15) having a U-shaped section and enclose at least a zone of the periphery of the device (1), by embedding and by pressure.

2. Device according to the claim 1, characterized in that the device comprises at least a compensation joint (12) laid out in central circumference of the opening (6) of the internal rings (5).

3. Device according to the claim 1, characterized in that the device comprises at least two interposition rings (13) respectively laid out in central circumference of the internal superimposed rings (5), the internal diameter of said interposition rings (13) being smaller than the diameter of the opening (6) of the internal rings (5).

4. Device according to the claim 1, characterized in that the device comprises two interposition rings (13) respectively laid out on the two faces of the adaptive structure (9), the internal diameter of these interposition rings (13) is smaller than the internal diameter (d4) of the adaptive structure (9) in order to form internal lips (14).

5. Device according to claim 1, characterized in that the device comprises at least a compensation joint (12) laid out in central circumference of the opening (9*a*) of the adaptive structure (9).

6. Device according to the claim 1, characterized in that the curved element (15) comprises at least a blocking lug (16) intended to correspond with a cavity (17) formed in the base structure (2).

7. Device according to claim 1, characterized in that the base structure (2), in folded position, comprises at the level of the connection element (4) a seam point (18) made by stitching, intended to maintain the first and second annular parts (3*a*, 3*b*) opposite one another, in order to obtain a half-closed base structure (2) like a bivalve.

* * * * *